US005154053A

United States Patent [19]

Ishida et al.

[11] Patent Number: 5,154,053

[45] Date of Patent: Oct. 13, 1992

[54] AIR-FUEL RATIO CONTROL APPARATUS FOR ENGINE

[75] Inventors: Kazumi Ishida, Aichi; Hiroshi Haraguchi; Toshio Kondo, both of Kariya, all of Japan

[73] Assignee: Nippondenso Co., Ltd., Kariya, Japan

[21] Appl. No.: 690,825

[22] Filed: Apr. 26, 1991

[30] Foreign Application Priority Data

Apr. 26, 1990 [JP] Japan ..... 2-110873

[51] Int. Cl.[5] ..... F01N 3/28

[52] U.S. Cl. ..... 60/276; 60/285

[58] Field of Search ..... 60/276, 285

[56] References Cited

U.S. PATENT DOCUMENTS

| | | | |
|---|---|---|---|
| 4,251,989 | 2/1981 | Norimatus | 60/276 |
| 4,253,302 | 3/1981 | Asano | 60/276 |
| 4,734,614 | 4/1988 | Katsuno et al. . | |

FOREIGN PATENT DOCUMENTS

| | | |
|---|---|---|
| 48-14916 | 2/1973 | Japan . |
| 58-72647 | 4/1983 | Japan . |
| 61-138840 | 6/1986 | Japan . |
| 1-286550 | 12/1986 | Japan . |

*Primary Examiner*—Douglas Hart

*Attorney, Agent, or Firm*—Cushman, Darby & Cushman

[57] ABSTRACT

An air-fuel ratio control apparatus in which an air-fuel ratio of a mixture gas supplied to an engine, especially, a gas engine, is controlled in accordance with an output signal of each of oxygen concentration sensors disposed in upper and lower streams of an exhaust gas catalyzer of the engine. The output signal of the oxygen concentration sensor disposed on the upper stream side of the catalyzer is provided as one input signal of an air-fuel ratio control unit and the output signal of the oxygen concentration sensor disposed on the lower stream side of the catalyzer is provided as an input signal of an output signal correction amount determination unit, respectively. A mixing member for mixing an exhaust gas is disposed in an upper stream of each oxygen concentration sensor to detect the concentration of oxygen in the exhaust gas which is well mixed. The air-fuel ratio control unit controls an air-fuel ratio of a mixture gas in accordance with the output signal of the oxygen concentration sensor disposed on the upper stream side of the catalyzer and an output signal correction amount which is an output signal of the output signal correction amount determination unit. Since the exhaust gas is sufficiently mixed by the mixing member, variations of a measured value caused by the attachment position of each oxygen concentration sensor ar eliminated, thereby making it possible to control the air-fuel ratio of the mixture gas to a value close to a theoretical air-fuel ratio with a satisfactory precision.

9 Claims, 11 Drawing Sheets

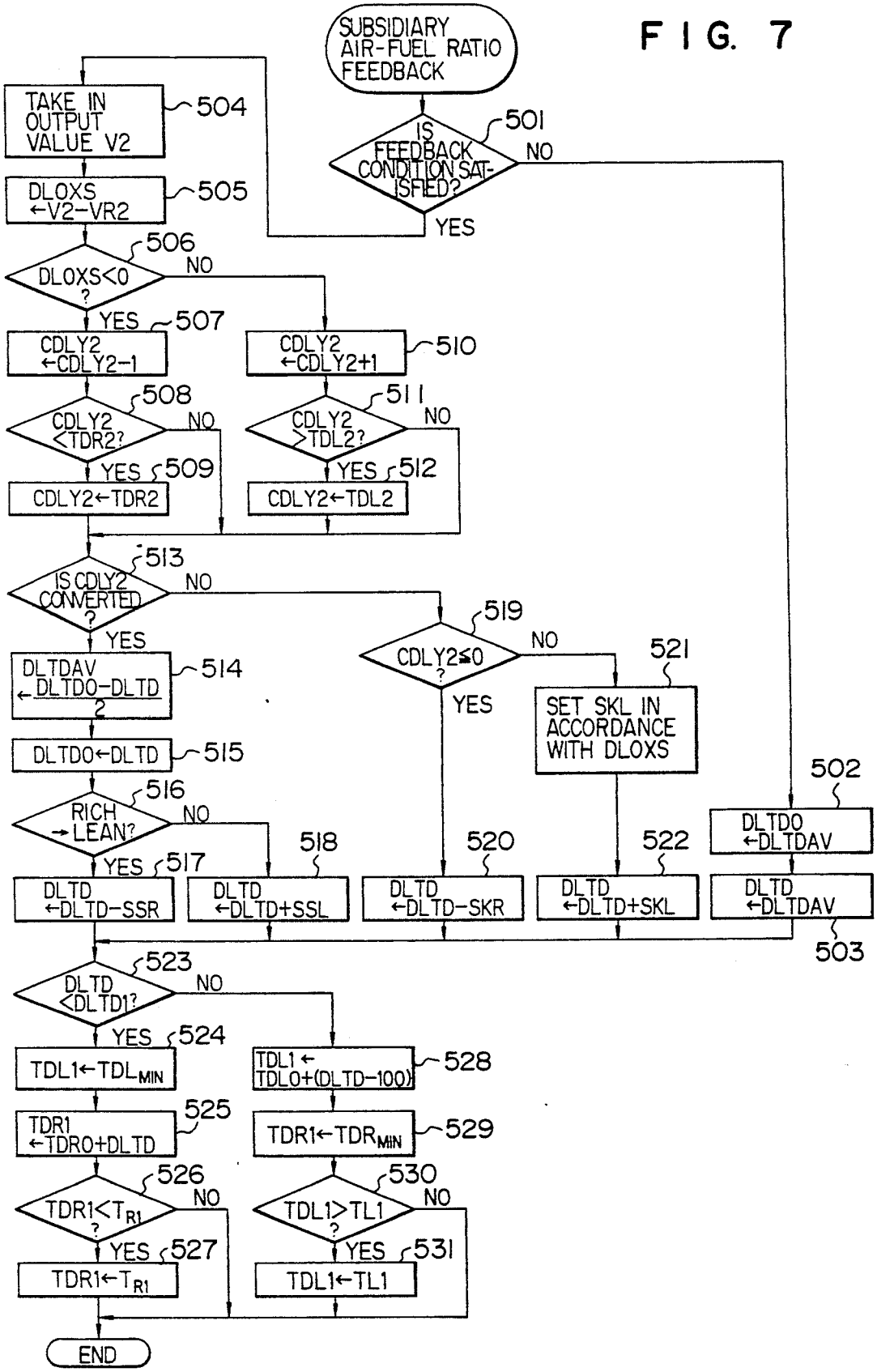
FIG. 7
SUBSIDIARY AIR-FUEL RATIO FEEDBACK
501
IS FEEDBACK CONDITION SATISFIED?
NO
YES
502
DLTDO ←DLTDAV
503
DLTD ←DLTDAV
504
TAKE IN OUTPUT VALUE V2
505
DLOXS ←V2−VR2
506
DLOXS<0 ?
NO
YES
507
CDLY2 ←CDLY2−1
508
CDLY2 <TDR2?
NO
YES
509
CDLY2←TDR2
510
CDLY2 ←CDLY2+1
511
CDLY2 >TDL2?
NO
YES
512
CDLY2←TDL2
513
IS CDLY2 CONVERTED ?
NO
YES
514
DLTDAV ← (DLTDO−DLTD)/2
515
DLTDO←DLTD
516
RICH →LEAN?
NO
YES
517
DLTD ←DLTD−SSR
518
DLTD ←DLTD+SSL
519
CDLY2≦0 ?
NO
YES
520
DLTD ←DLTD−SKR
521
SET SKL IN ACCORDANCE WITH DLOXS
522
DLTD ←DLTD+SKL
523
DLTD <DLTD1?
NO
YES
524
TDL1←TDLMIN
525
TDR1 ←TDRO+DLTD
526
TDR1<TR1 ?
NO
YES
527
TDR1←TR1
528
TDL1 ← TDLO+(DLTD−100)
529
TDR1←TDRMIN
530
TDL1>TL1 ?
NO
YES
531
TDL1←TL1
END

AIR-FUEL RATIO CONTROL APPARATUS FOR ENGINE

BACKGROUND OF THE INVENTION

1. Field of the Invention

The present invention particularly relates to an air-fuel ratio control apparatus for engine in which oxygen concentration sensors ($O_2$ sensors) are respectively disposed upstream and downstream streams of a catalyzer and an air-fuel ratio is controlled in accordance with the output signals of those sensors.

2. Description of the Related Art

As for gasoline engines, there is conventionally known an apparatus in which an air-fuel ratio is controlled to the vicinity of a theoretical air-fuel ratio (or a catalyzer window) in accordance with the output signal of an $O_2$ sensor disposed upstream of a catalyzer, thereby improving the rate of purification by the catalyzer.

Further, there is an air-fuel ratio control apparatus for gasoline engine in which a change in characteristic of the output signal of an $O_2$ sensor provided upstream of a catalyzer, or the like, is corrected in accordance with the output signal of an $O_2$ sensor provided in the lower stream of the catalyzer (for example, see JP-A-61-286550).

On the other hand, the present inventors have conducted experiments on engines using various gases such as a city gas and have revealed that an exhaust gas is not sufficiently mixed even downstream of a catalyzer. This is caused by the fact that the gas is harder to mix in the air, as compared with the gasoline. The above phenomenon remarkably appears, especially, in an apparatus in which an air-fuel ratio is controlled by adjusting an intake air or a fuel gas which is supplied to the upper stream of a throttle valve, by-passing a mixer for mixing the intake air and the fuel gas.

Accordingly, in the case where such air-fuel ratio control as mentioned above is applied to a gas engine, there is a problem that the output of an $O_2$ sensor disposed upstream or downstream of a catalyzer changes depending upon the attachment position of the $O_2$ sensor, for example, variations of the attachment position thereof in a direction of circumference of an exhaust pipe, thereby giving rise to variations of the control performance.

SUMMARY OF THE INVENTION

An object of the present invention made in the light of the above-mentioned revelation is to provide an air-fuel ratio control apparatus which is capable of controlling an air-fuel ratio to a theoretical air-fuel ratio with a satisfactory precision without being affected by the attachment position of an $O_2$ sensor disposed in the upper or lower stream of a catalyzer and without having a need to make a relation between the output of the $O_2$ sensor and an air-fuel ratio correction factor different for each system.

The subject matter of the present invention is an air-fuel ratio control apparatus for a gas engine, as shown in FIG. 1, comprising:

a catalyzer disposed in an exhaust system of a gas engine for purifying an exhaust gas;

a first oxygen concentration sensor disposed in an upper stream of the catalyzer for detecting the concentration of oxygen in the exhaust gas;

a second oxygen concentration sensor disposed in a lower stream of the catalyzer for detecting the concentration of oxygen in the exhaust gas;

a mixing member disposed in an upper stream of the second oxygen concentration sensor for mixing the exhaust gas;

output signal correction amount setting means for setting a output signal correction amount for correction of an output signal of the first oxygen concentration sensor in accordance with an output signal of the second oxygen concentration sensor; and air-fuel ratio control means for controlling an air-fuel ratio of a mixture gas supplied to the gas engine in accordance with the output signal correction amount and the output signal of the first oxygen concentration sensor.

In the above construction, the exhaust gas exhausted from the gas engine is mixed by the mixing member disposed in the upper stream of the second oxygen concentration sensor. The concentration of oxygen of the thus mixed exhaust gas in the lower stream of the catalyzer is detected by the second oxygen concentration sensor. The output signal correction amount for correction of the output signal of the first oxygen concentration sensor is set by the output signal correction amount setting means in accordance with the output signal from the second oxygen concentration sensor. And, the air-fuel ratio of the mixture gas supplied to the gas engine is controlled by the air-fuel ratio control means in accordance with the output signal correction amount and the output signal from the first oxygen concentration sensor.

BRIEF DESCRIPTION OF THE DRAWINGS

FIGS. 5 to 7 are flow charts useful in explaining the operation of the above embodiment;

DESCRIPTION OF THE PREFERRED EMBODIMENTS

An embodiment to which the present invention is applied will now be explained on the basis of the drawings.

Figure 1:
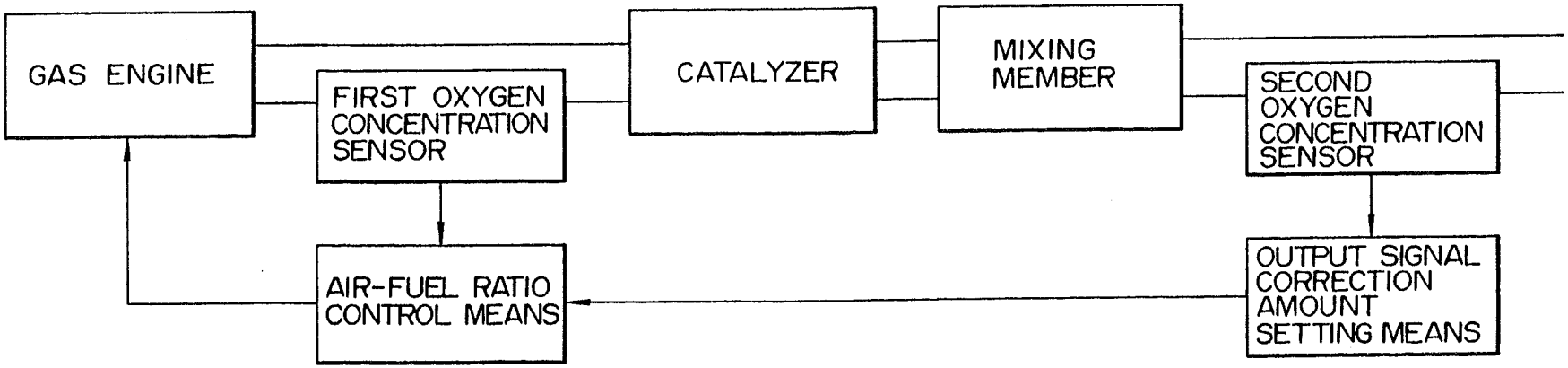
FIG. 1 is a block diagram showing the construction of the claimed invention.
Figure 2:
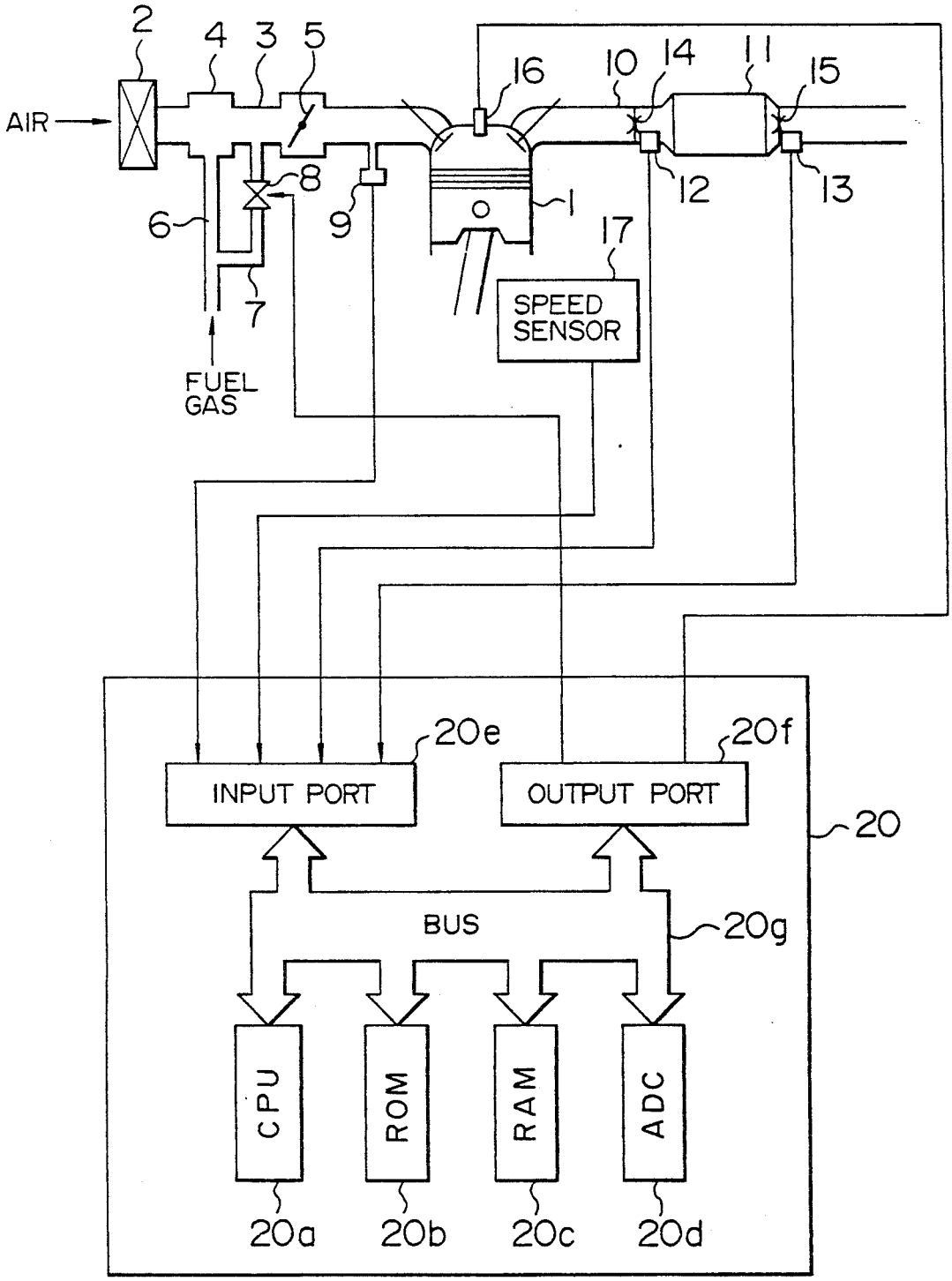
FIG. 2 is a block diagram of an embodiment to which the present invention is applied.

FIG. 2 is a block diagram of the present embodiment. Reference numeral 1 denotes a gas engine which uses a city gas as a fuel. An inlet system of the gas engine 1 is composed of an air cleaner 2 for cleaning an intake air and an inlet pipe 3 for introducing to the gas engine 1 a mixture gas of the intake air cleaned by the air cleaner 2 and a fuel gas supplied from a fuel gas supply source which is not shown. Further, the inlet pipe 3 is provided with a mixer 4 for mixing the intake air and the fuel gas to form a mixture gas which is slightly lean as compared with a theoretical air-fuel ratio and a throttle valve 5 for adjusting the amount of mixture gas to be supplied to the gas engine 1 (or a total gas flow rate). Also, there are provided a main supply path 6 which supplies the fuel gas from the gas supply source directly to the mixer 4 and a subsidiary supply path 7 which supplies the fuel gas from the gas supply source to a location downstream of the mixer 4. Further, the subsidiary supply path 7 is provided with a control valve 8 for air-fuel ratio control which adjusts the amount of fuel gas supplied from, the subsidiary supply path 7 (or a by-pass flow rate) so that the air-fuel ratio of the mixture gas supplied to the gas engine 1 is controlled to a desired value. Also, there is provided a pressure sensor 9 which detects an intake pressure PM downstream of the throttle valve 5.

Figure 3:
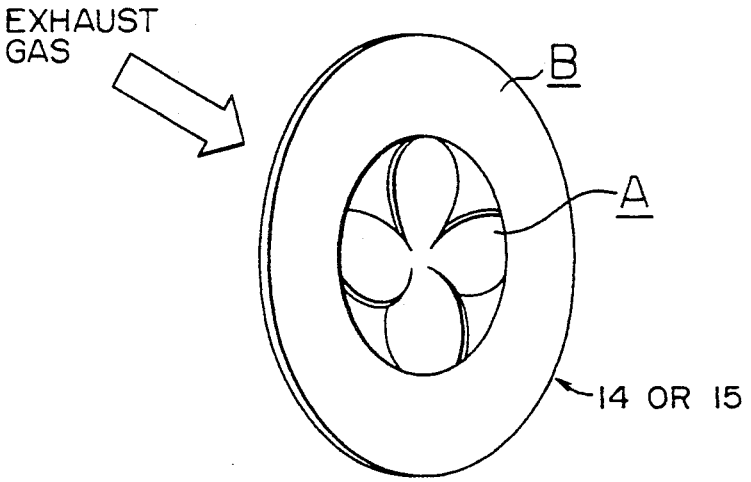
FIG. 3 is a perspective view of a blade plate 14 or 15.
Figure 4:
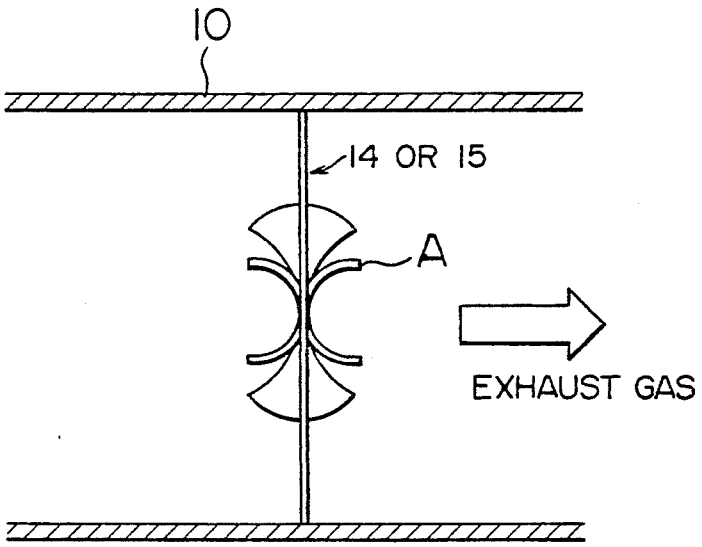
FIG. 4 is a cross section of the blade plate 14 or 15.

On the other hand, an exhaust system of the gas engine 1 includes an exhaust pipe 10 for guiding an exhaust gas from the gas engine 1. A ternary catalyzer 11 for purifying harmful components contained in the exhaust gas is disposed in the exhaust pipe 10. First and second oxygen concentration sensors ($O_2$ sensor ) 12 and 13 which detect the concentration of oxygen in the exhaust gas in order to detect the air-fuel ratio of the mixture gas supplied to the gas engine 1 are located upstream and downstream, respectively, of the catalyzer 11. Further, first and second blade plates 14 and 15 as mixing members for mixing the exhaust gas are respectively disposed upstream of the first $O_2$ sensor 12 and between the ternary catalyzer 11 and the second $O_2$ sensor 13. The material of the blade plates 14 and 15 is stainless steel (SUS304) in the present embodiment. FIG. 3 is a perspective view of the blade plate 14 or 15 and FIG. 4 is a cross section of the blade plate 14 or 15. In FIG. 3, A denotes a blade which corresponds to the radius of the inlet pipe and B denotes a mounting portion for attaching the blade plate 14 or 15 to the inlet pipe. Also, the blade plate 14 or 15 is provided with blades A which extend toward the upper and lower stream sides of the exhaust pipe 10, as shown in FIGS. 3 and 4. The blade A has a curved surface structure by which a scroll is caused to generate in the flow of the exhaust gas so that the exhaust gas is mixed.

Reference numeral 16 denotes a spark plug provided at a cylinder of the gas engine 1 and numeral 17 denotes a speed sensor for detecting the speed or number of rotation NE of the gas engine.

Reference numeral 20 denotes an electronic control unit (ECU) which sets the controlled variables for various actuators such as the above-mentioned control valve 8, spark plug 16, etc. and outputs control signals corresponding to the controlled variables. As well known, the ECU 20 is composed of a central processing unit (CPU) 20*a* which performs various operations, a read only memory (ROM) 20*b* in which a control program and so on are stored, a writable/readable random access memory (RAM) 20*c* which temporarily stores operation data and so on, an analog-digital converter (ADC) 20*d* which converts an analog signal into a digital signal, an input port 20*e* for taking sensor signals from the above-mentioned various sensors into the ECU 20, an output port 20*f* for outputting the control signals to the above-mentioned various actuators, and a bus 20*g* which interconnects these components.

Figure 8:
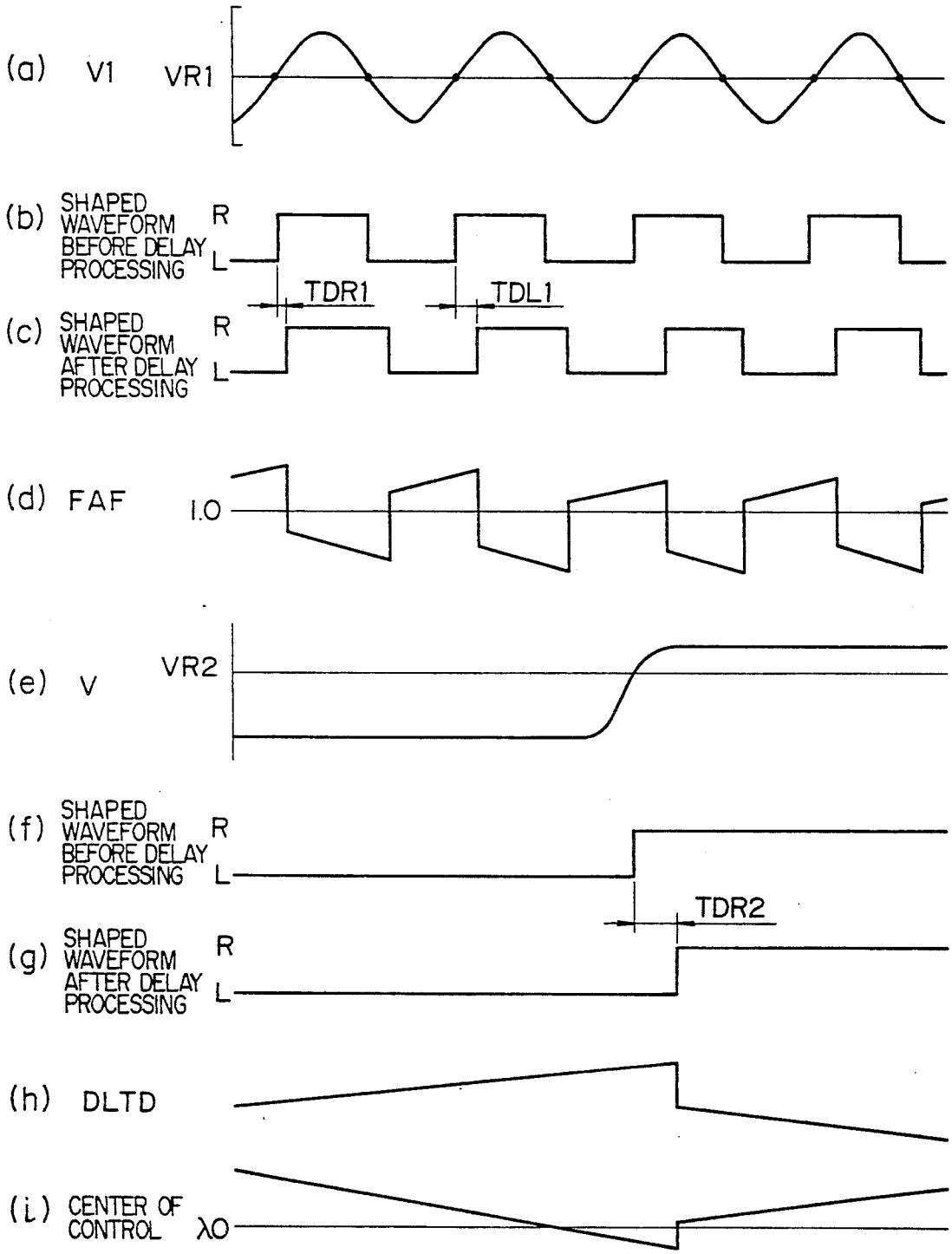
FIG. 8 shows, in (a) to (i), time charts useful in explaining the operation of the above embodiment.

In the following, a method of controlling the controlled variable for the control valve 8, that is, a method of controlling an air-fuel ratio of the gas engine will be explained by use of flow charts shown in FIGS. 5 to 7. FIG. 8 shows, in (a) to (i), a time chart of the present embodiment.

Figure 5:
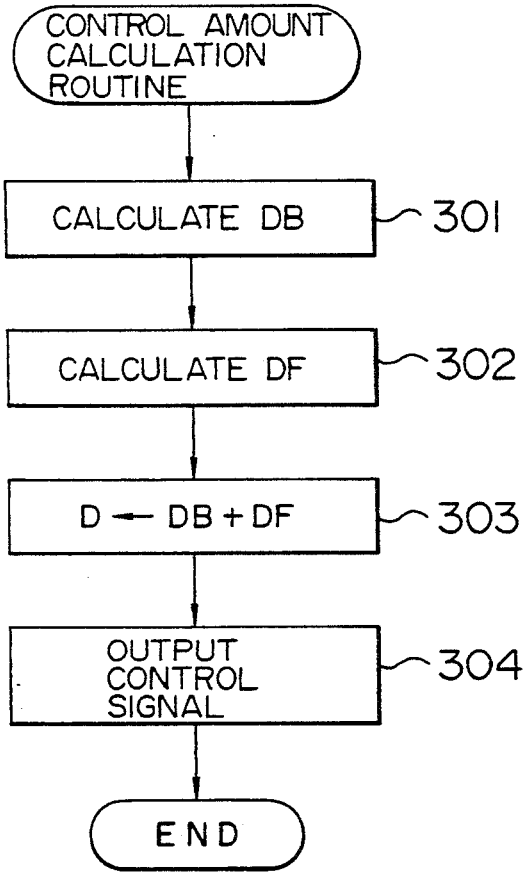
Figure 6:
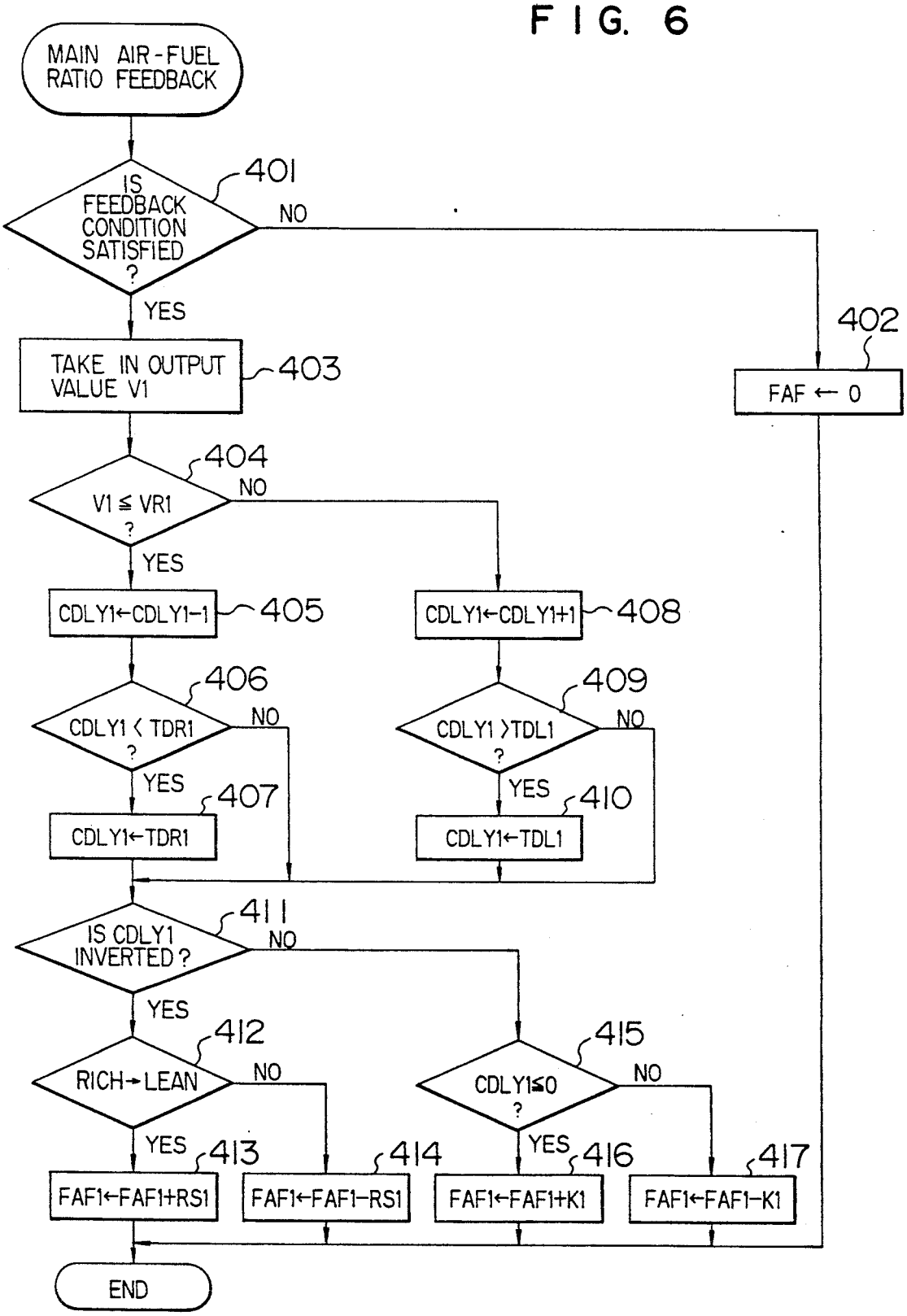

FIG. 5 is a flow chart showing a controlled variable calculation routine in which the controlled variable D for the control valve 8 is calculated.

Figure 9:
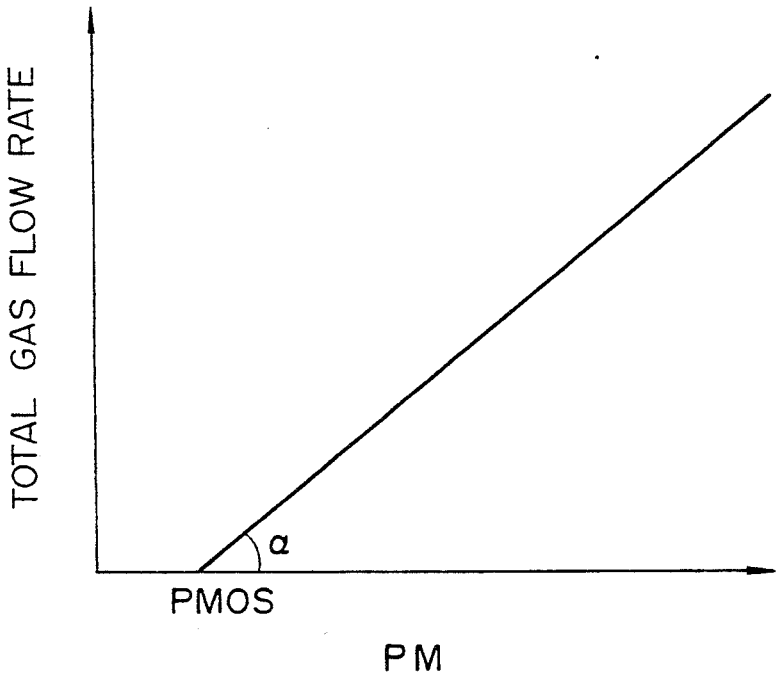
FIG. 9 is a graph showing a relation between an intake pressure PM and a total gas flow rate.
Figure 10:
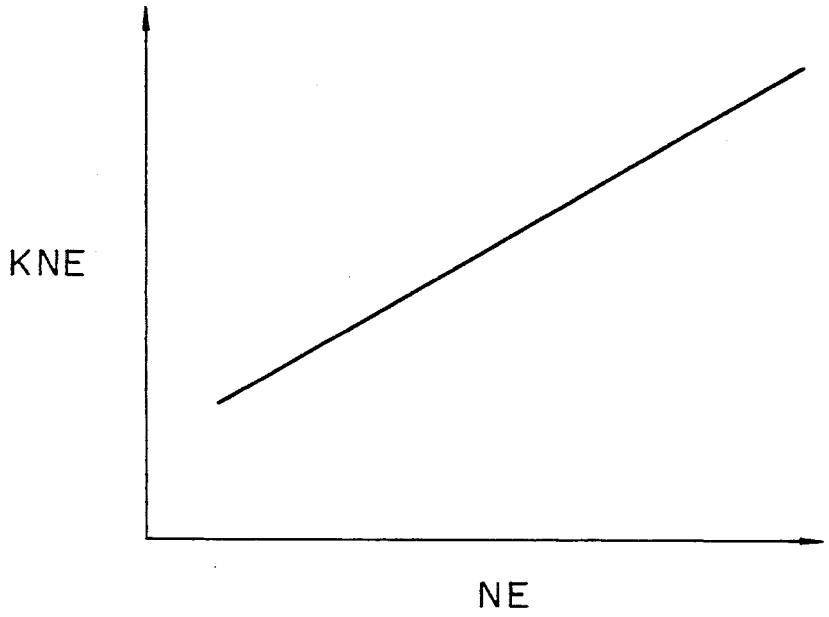
FIG. 10 is a graph showing a relation between an engine speed NE and an engine speed correction factor KNE.
Figure 11:
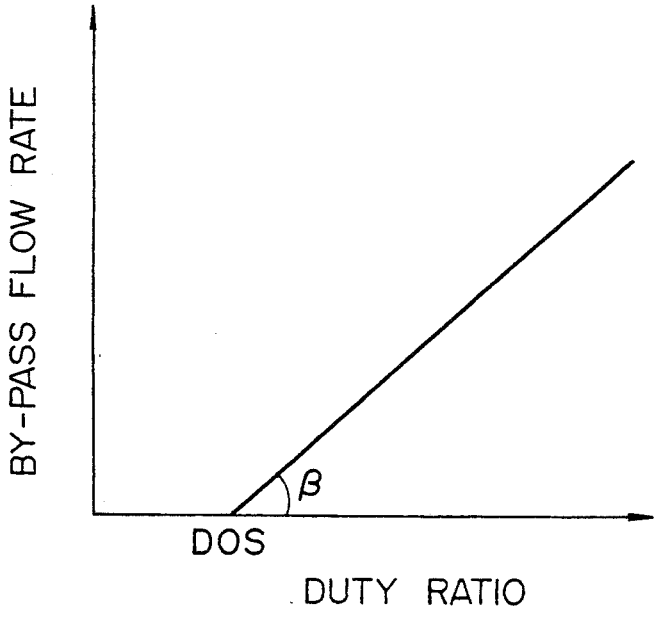
FIG. 11 is a graph showing a relation between a duty ratio and a by-pass flow rate.

Firstly in step 301, a basic control amount DB is calculated by the following equation in accordance with an intake pressure PM detected by the pressure sensor 9 and the engine speed NE detected by the speed sensor 17:

$$DB \leftarrow (PM-PMOS) \times KPMB \times KNE \times KDB + DOS$$

where PMOS is a constant value corresponding to an offset of such a relation between the intake pressure PM and a total gas flow rate as shown in FIG. 9, KPMB is a conversion coefficient for converting the intake pressure PM into a duty ratio, KNE is an engine speed correction factor corresponding to the engine speed NE which satisfies such a relation with the engine speed correction factor KNE as shown in FIG. 10, KDB is a correction factor set in accordance with the intake pressure PM and the engine speed NE, and DOS is a constant value corresponding to an offset of such a relation between the duty ratio and a by-pass flow rate as shown in FIG. 11.

In subsequent step 302, a corrected controlled variable DF is calculated by the following equation in accordance with the intake pressure PM, the engine speed NE and an air-fuel ratio correction factor which will be mentioned later:

$$DF \leftarrow (PM-PMOS) \times KPMF \times KNE \times FAF$$

where KPMF is a value which is set by the following equation on the basis of the gradient $\alpha$ of the intake pressure PM versus total gas flow rate characteristic shown in FIG. 9 and the gradient $\beta$ of the duty ratio versus by-pass flow rate shown in FIG. 11:

$$KPMF \leftarrow \alpha/\beta$$

In step 303, the controlled variable D is calculated in accordance with the thus calculated basic controlled variable DB and corrected controlled variable DF:

$$D \leftarrow DB + DF.$$

In step 304, a control signal corresponding to the controlled variable is outputted to the control valve 8.

In this manner, the controlled variable calculation routine is completed.

Next, a method of setting the air-fuel ratio correction factor FAF will be explained. FIG. 6 is a flow chart showing a main air-fuel ratio feedback control routine in which the air-fuel ratio correction factor FAF is calculated on the basis of an output value V1 of the first $O_2$ sensor 12 (or a first output value) as shown in (a) of FIG. 8. This main air-fuel ratio feedback control routine is actuated at every predetermined time (for example, every 4 ms in the present embodiment).

Firstly in step 401, the judgement is made of whether or not a main air-fuel feedback condition is satisfied. The main air-fuel ratio feedback condition is, for example, in the present embodiment, that the engine has been started up and the first $O_2$ sensor 12 is in an active state. In the case where the result of judgement in step 401 is that the main air-fuel ratio feedback condition is not satisfied, the flow proceeds to step 402 in which an air-fuel ratio correction factor FAF is set to 0 (FAF←0).

On the other hand, in the case where the result of judgement in step 401 is that the main air-fuel ratio feedback condition is satisfied, a main air-fuel ratio feedback processing in and after step 403 is performed. Firstly in step 403, a first output value V1 is taken in. In step 404, the judgement is made of whether or not the first output value V1 is not larger than a first comparison voltage VR1 (for example, 0.45 V in the present embodiment), that is, whether the air-fuel ratio is rich or lean. Namely, the first output value V1 as shown in (a) of FIG. 8 is judged as shown in (b) of FIG. 8. In the case where the first output value V1 is not larger than the first comparison valve VR1, that is, the air-fuel ratio is lean, the flow proceeds to step 405 in which the value of a first delay counter CDLY1 is decremented (CDLY1←CDLY1−1).

In subsequent steps 406 and 407, the first delay counter CDLY1 is subjected to a guard processing with a first lower limit TDR1. In particular, in step 406, the judgement is made of whether or not the first delay counter CDLY1 is smaller than the first lower limit TDR1. When the first delay counter CDLY1 is smaller than the first lower limit TDR1, the flow proceeds to step 407 in which the first delay counter CDLY1 is set to the first lower limit TDR1 again.

On the other hand, in the case where the result of judgement in step 404 is that the first output value V1 is larger than the first comparison voltage VR1, that is, the air-fuel ratio is rich, the flow proceeds to step 408 in which the value of the first delay counter CDLY1 is incremented (CDLY1←CDLY1+1). In subsequent steps 409 and 410, the first delay counter CDLY1 is subjected to a guard processing with a first upper limit TDL1. More specifically, in step 409, the judgement is made of whether or not the fist delay counter CDLY1 is larger than the first upper limit TDL1. When the first delay counter CDLY1 is larger than the first upper limit TDL1, the flow proceeds to step 410 in which the first delay counter CDLY1 is set to the first upper limit TDL1 again.

The above-mentioned first lower limit TDR1 is a first rich delay time for holding the judgement of the output of the first $O_2$ sensor 12 as being in a lean state notwithstanding the occurrence of a change from the lean state to a rich state, as shown in (c) of FIG. 8. The first lower limit TDR1 is defined by a negative value. Also, the first upper limit TDL1 is a first lean delay time for holding the judgement of the output of the first $O_2$ sensor 12 as being in a rich state notwithstanding the occurrence of a change from the rich state to a lean state, as shown in (c) of FIG. 8. The first upper limit TDL1 is defined by a positive value. Zero is taken as a reference level of the first delay counter CDLY1, and an air-fuel ratio after a delay processing is regarded as being rich when the first delay counter CDLY1 is positive and is regarded as being lean when the first delay counter CDLY1 is negative. In step 411, the judgement is made of whether or not the sign of the first delay counter CDLY1 set as mentioned above is inverted, that is, the air-fuel ratio after the delay processing is inverted. In the case where the air-fuel ratio after the delay processing is inverted, a skip processing in steps 412 to 414 is performed. Firstly or in step 412, the judgement is made of whether or not the inversion is one from a rich state to a lean state. In the case where the judgement a being the inversion one from a rich state to a lean state is made in step 412, the flow proceeds to step 413 in which the air-fuel ratio correction factor FAF is increased by a first amount of skip RS1 (FAF←FAF+RS1). Also, in the case where the judgement as being the inversion one from a lean state to a rich state is made in step 412, the flow proceeds to step 414 in which the air-fuel ratio correction factor FAF is decreased by the first amount of skip RS1 (FAF←FAF−RS1).

On the other hand, in the case where the result of judgement in step 411 is that the air-fuel ratio after the delay processing is not inverted, an integration processing in steps 415 to 417 is performed. Firstly or in step 415, the judgement is made of whether or not the first delay counter CDLY1 is not larger than O, that is, whether the air-fuel ratio is in a rich state or a lean state. In the case where the judgement as being a lean state is made in step 415, the flow proceeds to step 416 in which the air-fuel ratio correction factor is increased by a first integration constant K1 (FAF←FAF+K1). Also, in the case where the judgement as being a rich state is made in step 415, the flow proceeds to step 417 in which the air-fuel ratio correction factor FAF is decreased by the first integration constant K1 (FAF←FAF−K1).

The first integration constant K1 is set to be sufficiently small as compared with the first amount of skip RS1. Accordingly, in the case where the air-fuel ratio is in a lean state, the fuel gas supplied is gradually increased since the air-fuel ratio correction factor FAF is gradually increased, as shown in (d) of FIG. 8. Also, in the case where the air-fuel ratio is in a rich state, the fuel gas supplied is gradually decreased since the air-fuel ratio correction factor FAF is gradually decreased.

In this manner, the main air-fuel ratio feedback control routine is completed.

FIG. 7 is a flow chart showing a subsidiary air-fuel ratio feedback control routine in which the first delay times TDR1 and TDL1 as the amounts of correction for output signal are calculated on the basis of an output value V2 of the second $O_2$ sensor 13 (or a second output value) shown in (e) of FIG. 8. This subsidiary air-fuel ratio feedback control routine is activated at every predetermined time (for example, 1 s in the present embodiment).

Firstly or in step 501, the judgement is made of whether or not a subsidiary air-fuel ratio feedback condition is satisfied, that is, whether or not a subsidiary air-fuel ratio feedback control should be made. The case where the subsidiary air-fuel ratio feedback control condition is satisfied, corresponds to, for example, the case where there are satisfied all of conditions (1) that the main air-fuel ratio feedback condition is satisfied, (2) that the second $O_2$ sensor 13 is in an active state, and (3) that the ternary catalyzer 11 is deteriorated.

In the case where the result of judgement in step 501 is that the subsidiary air-fuel ratio feedback condition is not satisfied, the subsidiary air-fuel ratio feedback control in and after step 504 is not performed and the flow proceeds to step 502 in which a learning value DLTDAV, which will be mentioned later, is substituted for the preceding delay correction value DLTDO to prepare for the next subsidiary air-fuel ratio feedback control (DLTDO←DLTDAV). In subsequent step 503, the leaning value DLTDAV is substituted for a delay correction value DLTD (DLTD←DLTDAV), and the flow thereafter proceeds to step 523.

On the other hand, in the case where the result of jdugement in step 501 is that the subsidiary air-fuel ratio feedback condition is satisfied, that is, the subsidiary air-fuel ratio feedback control should be made, a processing in and after step 504 is performed.

Firstly or in step 504, the second output value V2 is taken in. In step 505, a deviation DLOXS (←V2−VR2) between the second output value V2 and a second comparison voltage VR2 is calculated. In subsequent step 506, the judgement is made whether or not the deviation DLOXS is smaller than 0, that is, whether the air-fuel ratio is rich or lean, as shown in (f) of FIG. 8. In the case where the deviation DLOXS is smaller than 0, that is, the air-fuel ratio is lean, the flow proceeds to step 507 in which the value of a second delay counter CDLY2 is decremented (CDLY2←CDLY2−1). In subsequent steps 508 and 509, the second delay counter is subjected to a guard processing with a second lower limit TDR2, and the flow thereafter proceeds to step 513. More especially, in step 508, the judgement is made of whether or not the second delay counter CDLY2 is smaller than the second lower limit TDR2. When the second delay counter CDLY2 is smaller than the second lower limit TDR2, the flow proceeds to step 509 in which the second delay counter CDLY2 is set to the second lower limit TDR2 again.

On the other hand, in the case where the result of judgement in step 506 is that the deviation DLOXS is equal to or larger than 0, that is, the air-fuel ratio is rich, the flow proceeds to step 510 in which the value of the second delay counter CDLY2 is incremented (CDLY2←CDLY2+1). In subsequent steps 511 and 512, the second delay counter CDLY2 is subjected to a guard processing with a second upper limit TDL2, and the flow thereafter proceeds to step 513. More especially, in step 511, the judgement is made of whether or not the second delay counter CDLY2 is larger than the second upper limit TDL2. When the second delay counter CDLY2 is larger than the second upper limit TDL2, the flow proceeds to step 412 in which the second delay counter CDLY2 is set to the second upper limit TDL2.

The above-mentioned second lower limit TDR2 is a second rich delay time for holding the judgement of the output of the second $O_2$ sensor 13 as being in a lean state notwithstanding the occurrence of a change from the lean state to a rich state, as shown in (g) of FIG. 8. The second lower limit TDR2 is defined by a negative value. Also, the second upper limit TDL2 is a second lean delay time for holding the judgement of the output of the second $O_2$ sensor 13 as being in a rich state notwithstanding the occurrence of a change from the rich sate to a lean state. The second upper limit TDR2 is defined by a positive value. Zero is taken as a reference level of the second delay counter CDLY2, and an air-fuel ratio after a delay processing is regarded as being rich when the second delay counter CDLY2 is positive and is regarded as being lean when the second delay counter CDLY2 is negative.

In step 513, the judgement is made of whether or not the second delay counter CDLY2 is inverted, that is, whether or not the air-fuel ratio after the delay processing is changed. In the case where the air-fuel ratio after the delay processing is changed, the flow proceeds to step 514 in which the mean of the preceding delay correction value DLTDO and a delay correction value DLTD is substituted for a learning value DLTDAV (DLTDAV←(DLTDO+DLTD)/2). In subsequent step 515, the delay correction value DLTD is substituted for the preceding delay correction value DLTDO (DLTDO←DLTD), and the flow thereafter proceeds to step 516. In step 516, the judgement is made of whether or not the inversion is one from a rich state to a lean state. In the case where the judgement as being the inversion from a rich state to a lean state is made in step 516, the flow proceeds to step 517 in which the delay correction value DLTD is decreased by a second amount of rich skip SSR (DLTD←DLTD−SSR), and the flow thereafter proceeds to step 523. Also, in the case where the judgement as being the inversion from a lean state to a rich state is made in step 516, the flow proceeds to step 518 in which the delay correction value DLTD is increased by the second amount of lean skip SSL (DLTD←DLTD+SSL), and the flow thereafter proceeds to step 523. The second amount of rich skip SSR is set to a value not smaller than the second amount of lean skip SSL. (In the present embodiment, the second amount of rich skip SSR and the second amount of lean skip SSL are set to the same value.)

Figure 12:
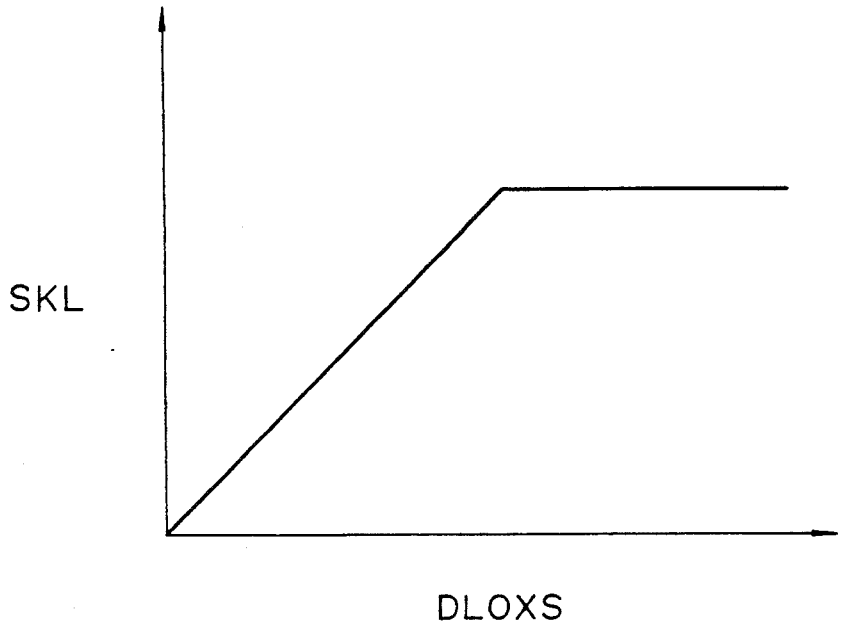
FIG. 12 is a graph showing a relation between a second lean integration constant and a deviation DLOXS.

On the other hand, in the case where the result of judgement in step 513 is that the air-fuel ratio after the delay processing is not inverted, the flow proceeds to step 519 in which the judgement is made of whether or not the second delay counter CDLY2 is not larger than 0, that is, whether the air-fuel ratio is in a rich state or a lean state. In the case where the judgement as being in a lean state is made in step 519, the flow proceeds to step 520 in which the delay correction value DLTD is decreased by a second rich integration constant SKR (DLTD←DLTD−SKR), and the flow thereafter proceeds to step 523. In the present embodiment, the second rich integration constant SKR is a predetermined value. Also, in the case where the judgement as being in a rich state is made in step 519, the flows proceeds to step 521 in which a lean integration constant SKL is set in accordance with the deviation DLOXS. FIG. 12 is a graph showing a relation between the deviation DLOXS and the lean integration constant SKL. In subsequent step 522, the delay correction value DLTD is increased by the second lean integration constant set in step 521 (DLTD←DLTD+SKL), and the flow thereafter proceeds to step 523.

In step 523, the detection is made of whether the delay correction value DLTD set as mentioned above is smaller than a reference value DLTD1. In the case where the delay correction value DLTD is smaller than the reference value DLTD1, the flow proceeds to step 524 in which a first lean delay time TDL1 is set to the minimum lean value TDLMIN. In subsequent step 525, the value of addition of the delay correction value DLTD and an initial rich value TDR0 is substituted for the first rich delay time TDR1 (TDSR1←TDR0+DLTD), and a guard processing in steps 526 and 527 is thereafter performed. More especially, in step 526, the judgement is made of whether or not the first rich delay time TDR1 is smaller than the lower limit TR1. In the case where the first rich delay time TDR1 is smaller than the lower limit TR1, the flow proceeds to step 527 in which the first rich delay time TDR1 is set to the lower limit TR1 again (TDR1←TR1), and the present routine is completed.

On the other hand, in the case where the delay correction value DLTD is equal to or larger than the reference value DLTD1, the flow proceeds to step 528 in which the first lean delay time TDL1 is set by the following equation:

$$TDL1 \leftarrow TDL0 + (DLTD - 100)$$

where TDL0 is an initial lean value. In subsequent step 529, the first rich delay time TDR1 is set to the minimum rich value TDRMIN, and a guard processing in steps 530 and 531 is performed. More especially, in step 530, the judgement is made of whether or not the first lean delay time TDL1 is larger than the upper limit TL1. In the case where the first lean delay time TDL1 is larger than the upper limit TL1, the flow proceeds to step 531 in which the first lean delay time TDL1 is set to the upper limit TL1 again (TDL1←TL1), and the present routine is completed.

The second integration constants SKR and SKL are set to be sufficiently small as compared with the second amounts of skip SSR and SSL. Therefore, in the case where the air-fuel ratio is in a lean state, the first rich delay time TDR1 is gradually increased or the first lean delay time TDL1 is decreased since the delay correction amount DLTD is gradually increased, as shown in (h) of FIG. 8. Also, in the case where the air-fuel ratio is in a rich state, the first rich delay time TDR1 is gradually decreased or the first lean delay time TDL1 is increased since the delay correction amount DLTD is gradually decreased. Accordingly, the center of control of the air-fuel ratio of a mixture gas supplied to the gas engine 1 is controlled so that it takes a theoretical air-fuel ratio λ0, as shown in (i) of FIG. 8.

Figure 15:
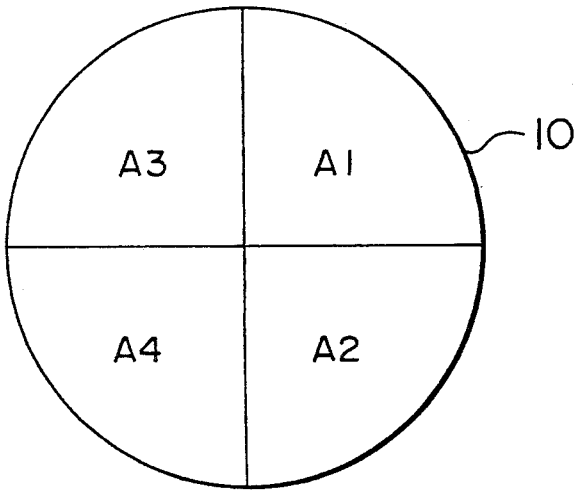
FIG. 15 is a diagram showing the distribution of an exhaust gas in a four-cylinder gas engine.

Further, an exhaust gas exhausted from the gas engine 1, for example, in the case of four cylinders, has an air-fuel ratio distribution for each cylinder in regions A1 to A4 in a circumferential direction with respect to a cross section of the exhaust pipe 10, as shown in FIG. 15. As for the air-fuel ratio distributions produced for the respective regions A1 to A4, a scroll is generated in the flow of the exhaust gas by the four blades A of the blade plates 14 and 15, which are the same in number as the number of cylinders, so that the exhaust gas is sufficiently mixed. Especially, by providing the blade plate 15 between the catalyzer 11 and the second $O_2$ sensor 13 disposed in the lower stream thereof, it is possible to eliminate an unevenness that the flow velocity of the exhaust gas passing through the catalyzer 11 is fast in a central portion and slow in the vicinity of a wall surface of the exhaust pipe 10. Accordingly, in an upper stream of the second $O_2$ sensor 13, the air-fuel ratio becomes an average value for all of the cylinders. Therefore, even if the attachment position of the second $O_2$ sensor 13 is changed, no variations are produced in the output of the $O_2$ sensor, thereby making it possible to eliminate variations of the control performance.

The foregoing embodiment has a structure in which the subsidiary supply path 7 is opened in an upper stream of the throttle valve 5 so that the fuel gas is by-passed to the upper stream of the throttle valve 5. However, there may be employed a structure in which the fuel gas is by-passed to a lower stream of the throttle valve 5 or a structure in which the intake air is by-passed in lieu of the fuel gas.

Figure 13:
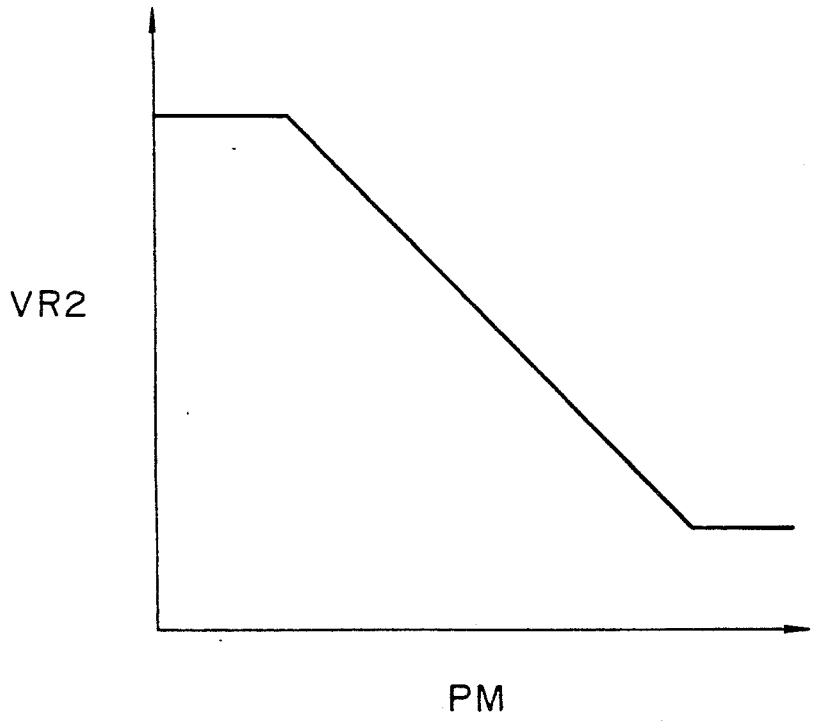
FIG. 13 is a graph showing a relation between the intake pressure PM and a second comparison voltage.

Also, in the foregoing embodiment, the second comparison voltage VR2 is a predetermined value. However, the second comparison voltage VR2 may be set in accordance with the intake pressure PM by use of a characteristic as shown in FIG. 13.

Figure 14:
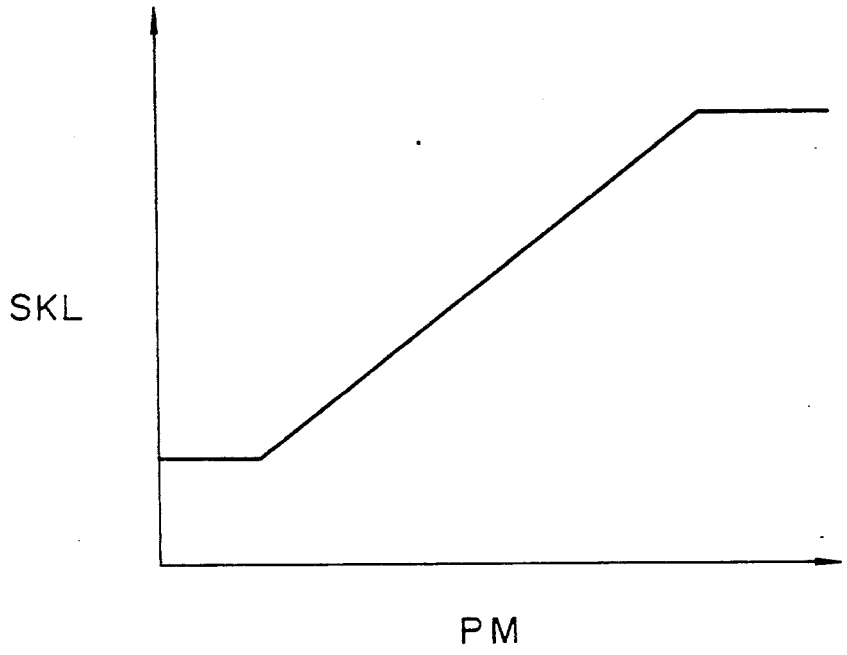
FIG. 14 is a graph showing a relation between the intake pressure PM and the second lean integration constant.

Further, in the foregoing embodiment, the second lean integration constant SKL is set in accordance with the deviation DLOXS. However, the second lean integration constant SKL may be set in accordance with the intake pressure PM by use of a characteristic as shown in FIG. 14.

In the foregoing embodiment, the attachment positions of the first and second blade plates 14 and 15 are upstream of the first $O_2$ sensor 12 and between the ternary catalyzer 11 and the second $O_2$ sensor 13. However, the attachment position of the first blade plate 14 may be between the first $O_2$ sensor 12 and the ternary catalyzer 11. Also, a blade plate may be provided only upstream of the first $O_2$ sensor 12. Further, in the case of a system having only one $O_2$ sensor, a blade plate may be provided on an upper stream side of that $O_2$ sensor.

As has been described in detail, in the present invention, since an exhaust gas is sufficiently mixed by a mixing member provided in an upper stream of an oxygen concentration sensor, there is an excellent effect that variations of the control performance depending upon the attachment position of the $O_2$ sensor are eliminated and hence an air-fuel ratio can be controlled to a theoretical air-fuel ratio with a satisfactory precision.

We claim:

1. An air-fuel ratio control apparatus for an engine, comprising:

a catalyzer disposed in an exhaust system of an engine for purifying an exhaust gas;

a first oxygen concentration sensor disposed upstream of said catalyzer for detecting an upstream concentration of oxygen in the exhaust gas;

a second oxygen concentration sensor disposed downstream of said catalyzer for detecting a downstream concentration of oxygen in the exhaust gas;

a mixing member, having mixing blades, disposed upstream of said second oxygen concentration sensor for mixing the exhaust gas;

output signal correction amount setting means for setting an output signal correction amount for correction of an output signal of said first oxygen concentration sensor in accordance with an output signal of said second oxygen concentration sensor; and air-fuel ratio control means for controlling an air-fuel ratio of a mixture gas supplied to said engine in accordance with said output signal correction amount and the output signal of said first oxygen concentration sensor.

2. An air-fuel ratio control apparatus for engine according to claim 1, wherein said engine is a gas engine.

3. An air-fuel ratio control apparatus for an engine, comprising:

a catalyzer disposed in an exhaust system of an engine for purifying an exhaust gas;

a first oxygen concentration sensor disposed upstream of said catalyzer for detecting an upstream concentration of oxygen in the exhaust gas;

a second oxygen concentration sensor disposed downstream of said catalyzer for detecting a downstream concentration of oxygen in the exhaust gas;

a mixing member including blades for causing a vortex to be generated in said exhaust gas, disposed upstream of said second oxygen concentration sensor for mixing the exhaust gas;

output signal correction amount setting means for setting an output signal correction amount for correction of an output signal of said first oxygen concentration sensor in accordance with an output signal of said second oxygen concentration sensor; and air-fuel ratio control means for controlling an air-fuel ratio of a mixture gas supplied to said engine in accordance with said output signal correction amount and the output signal of said first oxygen concentration sensor.

4. An air-fuel ratio control apparatus for an engine, comprising:

a catalyzer disposed in an exhaust system of an engine for purifying an exhaust gas;

a first oxygen concentration sensor disposed upstream of said catalyzer for detecting the concentration of oxygen in the exhaust gas;

a second oxygen concentration sensor disposed downstream of said catalyzer for detecting the concentration of oxygen in the exhaust gas;

mixing members disposed upstream of said first and second oxygen concentration sensors, respectively, each of said mixing members having blades for causing a vortex to be generated in said exhaust gas;

output signal correction amount setting means for setting an output signal correction amount for correction of an output signal of said first oxygen concentration sensor in accordance with an output signal of said second oxygen concentration sensor; and air-fuel ratio control means for controlling an air-fuel ratio of a mixture gas supplied to said engine in accordance with said output signal correction amount and the output signal of said first oxygen concentration sensor.

5. An air-fuel ratio control apparatus for an engine comprising:

a catalyzer disposed in an exhaust system of an engine for purifying an exhaust gas;

a first oxygen concentration sensor disposed upstream of said catalyzer for detecting an upstream concentration of oxygen in the exhaust gas;

a second oxygen concentration sensor disposed downstream of said catalyzer for detecting a downstream concentration of oxygen in the exhaust gas;

a mixing member having mixing blades disposed upstream of said second oxygen concentration sensor for mixing the exhaust gas;

output signal correction amount setting means for setting an output signal correction amount for correction of an output signal of said first oxygen concentration sensor in accordance with an output signal of said second oxygen concentration sensor;

air-fuel ratio control means for controlling an air-fuel ratio of a mixture gas supplied to said engine in accordance with said output signal correction amount and the output signal of said first oxygen concentration sensor; and a mixer for mixing an intake air and a fuel gas;

a subsidiary supply path for supplying at least one of the intake air and the fuel gas upstream of a throttle valve with said mixer being by-passed; and a control valve for adjusting an opening area of said subsidiary supply path to control at least one of the intake air and the fuel gas supplied upstream of said throttle valve.

6. An air-fuel ratio control apparatus for engine according to claim 3, further comprising:

a mixer for mixing an intake gas and a fuel gas;

a subsidiary supply path for supplying at least one of the intake gas and the fuel gas to an upper stream of a throttle valve with said mixer being by-passed; and a control valve for adjusting an opening area of said subsidiary supply path to control at least one of the intake air and the fuel gas supplied to the upper stream of said throttle valve.

7. An air-fuel ratio control apparatus for an engine according to claim 4, further comprising:

a mixer for mixing an intake air and a fuel gas;

a subsidiary supply path for supplying at least one of the intake air and the fuel gas upstream of a throttle valve with said mixer being by-passed; and a control valve for adjusting an opening area of said subsidiary supply path to control at least one of the intake air and the fuel gas supplied upstream of said throttle valve.

8. An air-fuel ratio control apparatus for an engine, comprising:

a catalyzer disposed in an exhaust system of an engine for purifying an exhaust gas;

oxygen concentration sensors disposed upstream and downstream of said catalyzer, respectively, for detecting a concentration of oxygen in the exhaust gas;

a mixing number, having mixing blades, disposed upstream of at least one of said oxygen concentration sensors for mixing the exhaust gas; and air-fuel ratio control means for controlling an air-fuel ratio of a mixture gas supplied to said engine in accordance with an output signal of each of said oxygen concentration sensors.

9. An air-fuel ratio control apparatus for an engine, comprising:

a catalyzer disposed in an exhaust system of an engine for purifying an exhaust gas;

oxygen concentration sensors disposed upstream and downstream of said catalyzer, respectively, for detecting a concentration of oxygen in the exhaust gas;

a mixing member, having mixing blades disposed upstream of said oxygen concentration sensors for mixing the exhaust gas; and air-fuel ratio control means for controlling an air-fuel ratio of a mixture gas supplied to said engine in accordance with output signals of said oxygen concentration sensors.

* * * * *